US005292024A

United States Patent [19]

Koefelda et al.

[11] Patent Number: 5,292,024

[45] Date of Patent: Mar. 8, 1994

[54] PLASTIC PAIL ASSEMBLY FOR HAZARDOUS MATERIALS

[75] Inventors: Gerald R. Koefelda, Seal Beach; Arne Lang-Ree, Menlo Park, both of Calif.

[73] Assignee: Rehrig Pacific Company, Inc., Los Angeles, Calif.

[21] Appl. No.: 885,755

[22] Filed: May 19, 1992

[51] Int. Cl.[5] ..... B65D 41/20

[52] U.S. Cl. ..... 220/608; 220/635; 220/306; 206/519

[58] Field of Search ..... 220/652, 653, 608, 609, 220/635, 306; 206/515, 519

[56] References Cited

U.S. PATENT DOCUMENTS

| | | | |
|---|---|---|---|
| 975,342 | 11/1910 | Firth . | |
| 1,045,055 | 11/1912 | Mittinger, Jr. | 220/623 |
| 1,182,466 | 5/1916 | Ferguson | 220/623 |
| 3,140,796 | 7/1964 | Broida | 220/608 |
| 3,515,306 | 6/1970 | Roper et al. | 220/60 |
| 3,516,571 | 6/1970 | Roper et al. . | |
| 3,583,623 | 6/1971 | Golner | 220/608 |
| 3,946,897 | 3/1976 | Wolff | 220/306 |
| 3,998,355 | 12/1976 | Galer | 220/608 |
| 4,014,452 | 3/1977 | Galer | 220/74 |
| 4,034,886 | 7/1977 | Galer | 220/72 |
| 4,054,219 | 10/1977 | Young et al. | 220/608 |
| 4,256,240 | 3/1981 | Woinarski | 220/306 |
| 4,420,093 | 12/1983 | Von Holdt | 220/306 |
| 4,512,493 | 4/1985 | Von Holdt | 220/306 |
| 4,525,401 | 6/1985 | Pocock et al. | 220/608 |
| 4,577,775 | 3/1986 | Kresin | 220/608 |
| 4,643,311 | 2/1987 | Höhlein et al. | 206/508 |
| 4,708,258 | 11/1987 | Shaw et al. | 220/288 |
| 4,712,711 | 12/1987 | Geering et al. | 220/457 |
| 4,941,588 | 7/1990 | Flider | 220/302 |
| 5,096,083 | 3/1992 | Shaw et al. | 220/304 |

FOREIGN PATENT DOCUMENTS

| | | |
|---|---|---|
| 718150 | 10/1966 | Italy . |
| 1379246 | 1/1975 | United Kingdom . |

*Primary Examiner*—Joseph Man-Fu Moy
*Attorney, Agent, or Firm*—Banner, Birch, McKie & Beckett

[57] ABSTRACT

A pail assembly including a plastic pail and a plastic lid which can be snap fit sealed to the top of the pail. To reduce excessive outward doming of the lid and the pail floor caused by internal pail pressures, due for example to chemical reactions of hazardous material contents, rib structures are formed on and extend across the interior surfaces of both the floor and the lid. To prevent this doming the floor is also formed to be bowed upwardly at its center with a small curvature radius. A large radius connection of the floor to the pail sidewall better distributes impact stresses. A locating ring channel is formed on the lid surface and is dimensioned to receive therein the feet of two different size pails when the pails are loaded and stacked. Ribs on the outside and inside of the channel resist the tipping of the pails of either size when alternatively stacked thereon.

9 Claims, 12 Drawing Sheets

PLASTIC PAIL ASSEMBLY FOR HAZARDOUS MATERIALS

BACKGROUND OF THE INVENTION

The present invention relates to plastic pails and lids therefor for carrying hazardous materials and the like.

A number of plastic pails for carrying hazardous materials and the like are known. Most have flat or nearly flat pail bottoms. Some have circular support members of protectors extending down from the floor at the center thereof, surrounding and protecting the gate, which is the small raised sharp nub where the plastic material was injected and which forms a weak area of the pail. A circular protector is shown, for example, in U.S. Pat. No. 3,516,571 ('571). (This and each of the other patents and publications mentioned anywhere in this disclosure hereby are incorporated by reference in their entireties.) The lids for the prior art pails are also generally flat on top. Some snap into place in a removable sealing engagement such as those shown in the '571 patent and in U.S. Pat. Nos. 3,515,306, and 3,770,156. A screw-on lid manufactured by Container Products of Southfield, Mich. and described in their four-page color brochure entitled "Samson Screw-Top Top Pails" is also known.

These pails when designed to be used for carrying hazardous materials must meet certain governmental requirements, including those of the U.S. Department of Transportation, such as DOT-35, and/or the United Nations specifications. The UN specifications are effective in the United States in 1994, and until then pails can meet either the DOT or the UN specification. While the DOT specifications are structure specific such as specifying minimum wall thicknesses and so forth, the UN specifications are performance based and include certain tests which the pail must pass including a drop test, a vibration test and a stack test. The certification tests for solid wastes are generally speaking less stringent than those for liquid wastes.

After the hazardous wastes have been packaged in the pails and the lids secured to them, the loaded pails must be transported to the desired location and the waste therein disposed of in some environmentally acceptable manner. One appealing disposal method, which has been further developed by Cadence Chemical Resources, Inc. of Michigan City, Ind., is described in the article entitled "Cadence Chemical Resources, Inc., Company Develops New Solid Waste Fuel Process," *EI Digest*, September 1989, and in the brochure available from Southdown, Inc. of Houston, Tex., and entitled "A Cement Kiln Doesn't Just Destroy Hazardous Waste, It Also Recovers Energy from Them." According to this process the lid, the pail and the hazardous wastes therein are all dropped into a cement kiln at a specific location in the kiln process. The hazardous waste is not only destroyed but actually advantageously creates a fuel that can replace 20–50% of the coal that is used to heat a typical cement kiln. Solid hazardous materials are first blended by a process patented by Cadence to make them a more efficient fuel; the hazardous waste is mixed enough to obtain a consistent BTU output when the pail and wastes are burned. There is also no resulting toxic solid or gaseous wastes from this cement kiln burning. The temperature in the kiln reaches approximately 3700°, and thus the waste breaks apart chemically. The organic compounds are destroyed and the inorganic compounds bond with the raw material in the kiln to form the cement clinker. The clinker when it leaves the kiln is cooled, mixed with gypsum, ground into a fine cement powder and then trucked to ready-mix concrete makers, as is known in the art.

Examples of waste materials which can be used with the Cadence process include paint thinners, printing inks, pain residues, industrial cleaning solvents and sludges. And an example of a sludge is the residue left at the bottom of coal ponds. Coal mines typically filter the mine gases through an adjacent pond, and the bottoms of these ponds become toxic after many years of use and need to be cleaned up. The toxic dirt or sludge after being scraped off the bottom of the ponds, then needs to be transported and then typically burned.

The pails of hazardous waste can be palletized and transported in a stacked arrangement to the location of the cement kiln where they are unloaded and transported individually on roller conveyors. There they are dropped through a feed tube to the desired location in the kiln. If the pails have wire handles the handles tend to get hung up on the feed tubes. When transported to the location of the kiln, the loaded and lid-sealed pails are typically stacked on conventional wooden pallets, typically two or three pails high and in a 3×3 square or a 3×4 rectangle. After being stacked they are shrink wrapped to hold them together. The shrink wrapping process involves simply taking a large piece of Saran wrap type of material, hooking the end onto the pallet, walking with the roll around the loaded and stacked pails, ripping it off and tucking the ends into place. Although the shrink wrap may overlap the top or bottom of the pallet stack, it typically is not wrapped around the top or bottom of the pallet or stacked pails. This wrapping can be done manually or mechanically. The loaded pallets may also be stacked two pallets high when being warehoused.

One known pail, the "ROPAC" pail available from Schoeller, has flat surfaces projecting out from the sidewalls of the pails and having friction surfaces thereon. These flat surfaces then mate with flat surfaces of adjacent pails to keep the pails fixed relative to one another when transported on the pallets. The flat-against-flat contact provides a more stable load because of small locking mechanisms or friction grips.

Problems in the past have occurred though in this transporting of the loaded pails, as from the processors to the kilns. Internal pressures often develop in the pails because of the chemical reactions of the hazardous wastes in them. These pressures according to one rough estimate can be on the order of two, three or even six psi. These pressures with the prior art snap-on lid type pails cause the tops of the lids and the bottoms of the pails to dome outwardly. At a certain point the doming becomes so severe that when one pail is stacked on top of another the two domed or spherical shaped surfaces of the lid on the bottom pail and the floor on the top pail meet. This forms an unstable stack, similar to trying to balance one ball on top of another. Additionally, when they are not stacked and are being transported on a roller conveyor, the downwardly domed floor can get caught in the roller conveyor or at least not travel well along it. The circular gate protector can also be caused to extend downwardly and get caught or impacted. Further, if the internal pressure reaches a certain high level the snap on lid can dome up to such an extent that it loses its seal around the top of the pail and pops off.

Before the pails are loaded into the kiln every so many pails must be checked to make sure its contents are proper and a lid then placed back on it. The processor may also want to reenter the pail to compact its bulky lightweight contents to maximize content weight, before transporting to the kiln. One technique is to physically cut the vertical wall around the circumference to allow removal of the lids. Another method is to use a lever device such as the plastic lever opener of Consolidated Plastics Co., Inc. (216-425-3900; reorder 33434) which has its handle and fulcrum at opposite tool ends and its pry hook between them, thereby limiting the moment arm and the leverage available.

SUMMARY OF THE INVENTION

Accordingly, it is a primary object of the present invention to provide an improved plastic pail and lid design which better resists the doming problems experienced by prior art pails; this design must also meet DOT and/or UN specifications for pails for hauling (solid) hazardous materials.

Directed to achieving this object, an improved pail assembly is herein disclosed which includes a plastic pail and a snap-on plastic lid for it. The floor of the pail is bowed upwardly and has a smooth curve connecting it to the sidewall to provide greater distribution of stresses. A rib structure is integrally molded on the top of the floor and extends across the extent of the floor up to and along the sidewall. A preferred rib construction includes a central circular rib and four or more radial ribs extending radially out from it. The lid similarly on its interior or underneath side has a rib structure with a circular rib and radial ribs extending out therefrom across generally the entire lower surface of the lid. A locating ring on the top of the lid has anti-tipping retainer ribs on its inner and outer peripheries to restrain tipping of two different size pail bases when alternatively stacked thereon. A skirt around the pail sidewall has flat areas with friction surfaces to allow for stable palletizing and between the flat areas is configured to provide integral handholds. The pail and the lid are symmetrical about their longitudinal centerlines as indicated in the drawings.

Other objects and advantages of the present invention will become more apparent to those persons having ordinary skill in the art to which the present invention pertains from the foregoing description taken in conjunction with the accompanying drawings.

DETAILED DESCRIPTION OF PREFERRED EMBODIMENTS

Figure 1:
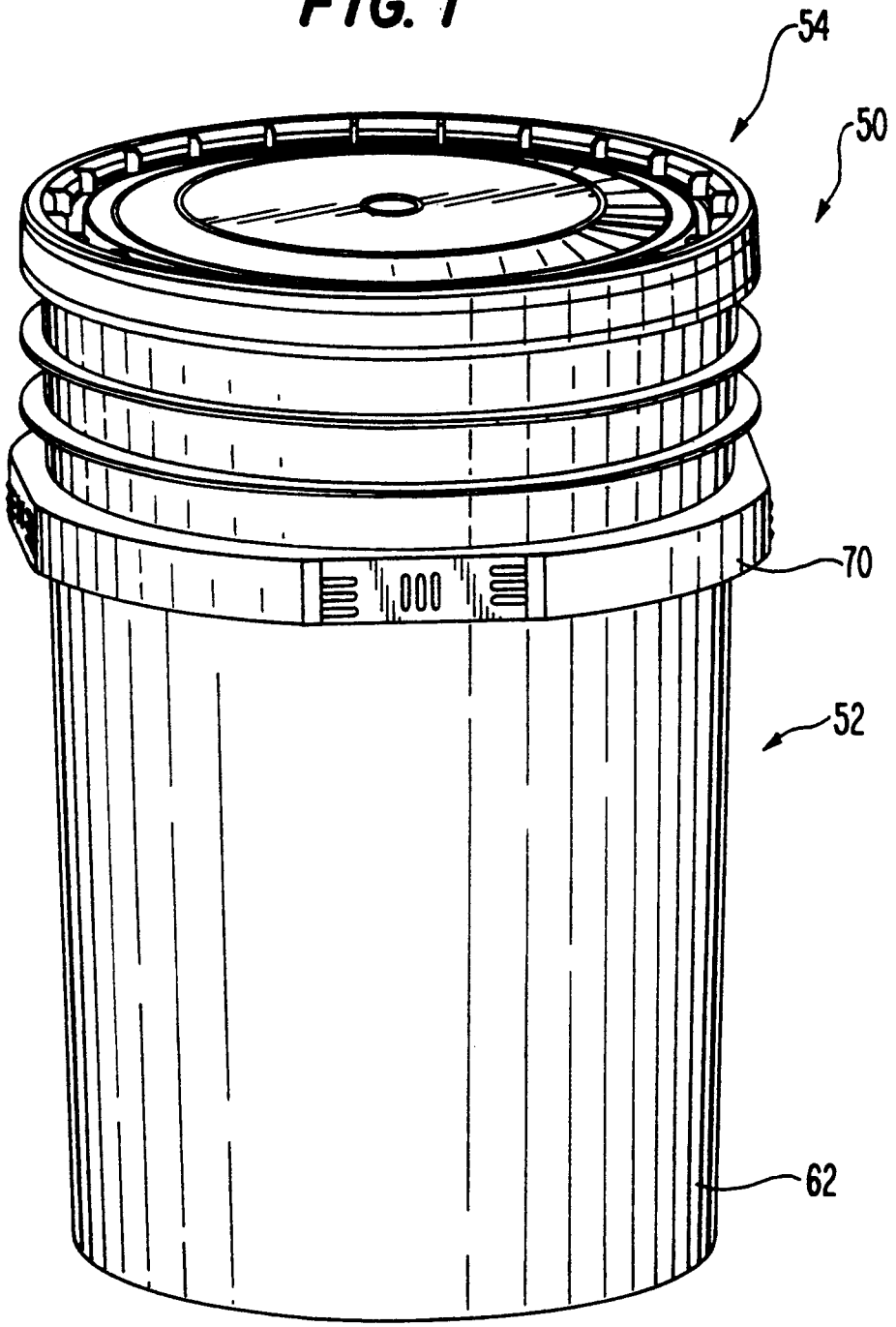
FIG. 1 is a top perspective view of a pail assembly of the present invention.
Figure 4:
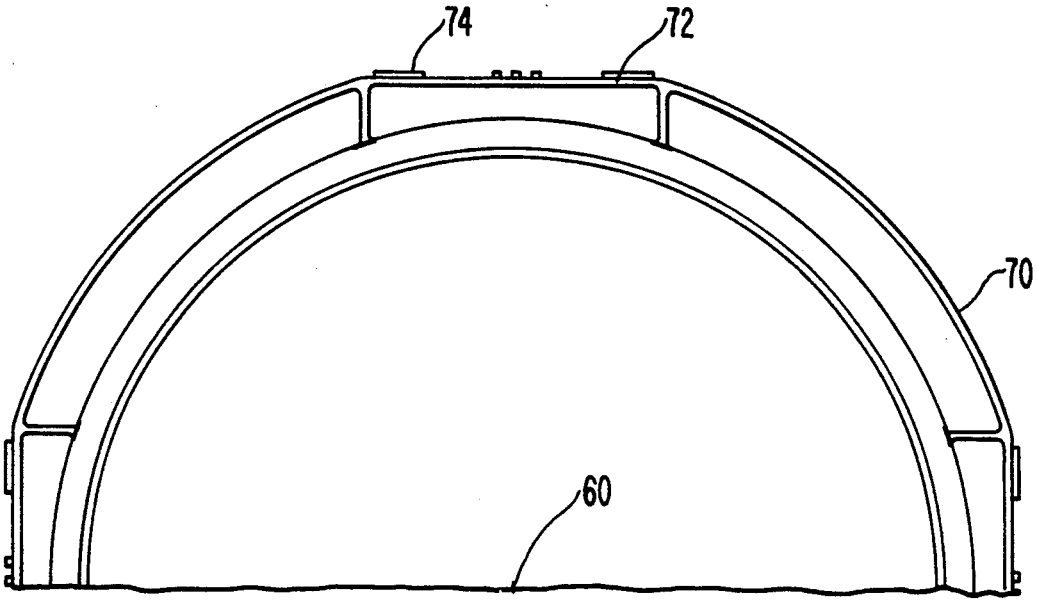
FIG. 4 is a bottom view of the pail of FIG. 2.
Figure 9:
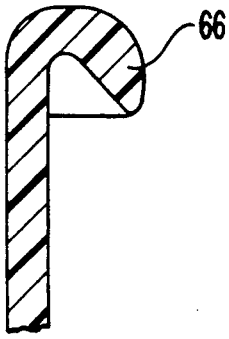
FIG. 9 is an enlarged view taken on circle 9 of FIG. 7.
Figure 18:
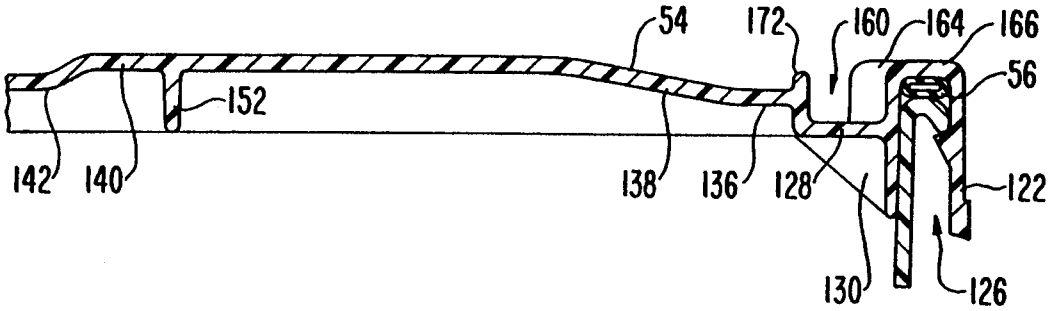
FIG. 18 is a cross-sectional view showing the lid of FIG. 1 snap fit onto the pail of FIG. 1 and sealed in place using an O-ring seal.

A plastic pail assembly of the present invention for storing and transporting hazardous materials and the like, and particularly solid hazardous material, is illustrated generally at 50 in FIG. 1. The pail assembly 50 is shown to comprise a plastic pail shown generally at 52 and a plastic lid shown generally at 54 secured to the pail in a snap fit arrangement, as best illustrated in FIG. 18 and utilizing an O-ring seal 56, made of natural rubber, elastic polymers or the like. Referring to FIGS. 2–7 it is seen that the pail 52 is formed in a one piece injection molding process of polyethylene plastic material, injected at a single injection point 60 as shown in FIGS. 3 and 4. The pail 52 itself is formed with a sidewall 62 having a small draft angle of 1.6 degrees and having a thickness which is slightly less at the top (0.095 inch) than at the bottom (0.105 inch). An outward lip or annular sealing bead 66 is formed at the top of the sidewall 62 as shown in FIG. 9.

Figure 8:
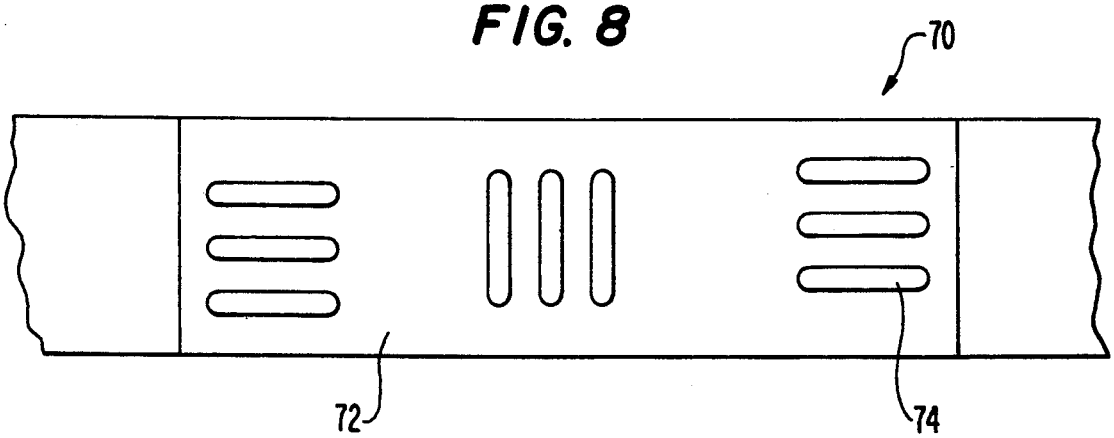
FIG. 8 is an enlarged view taken on circle 8 of FIGS. 5 and 6.

Spaced a distance below the bead 66 and extending around and integrally molded with the sidewall 62 is a skirt 70 having four flattened portions 72, each having thereon a pattern of elongated raised ribs or gripping members 74, as shown in FIG. 8. Similar to the previously-described Schoeller pail these flattened areas 72 with ribs 74 provide a gripping surface so that loaded pails positioned on a pallet can contact each other and provide a gripping relationship between them to prevent relative movement, and thereby form a more stable load. The design of flattened areas 72 and ribs 74 is advantageous over the ROPAC pail in that they are larger, making it easier to align the pails. Also, it is incorporated on a skirt (70) which can also be used as a handle, as explained below. The areas of the skirt 70 between the flattened areas 72 uniquely provide adequate hand-hold spaces 78 for easy grasping and carrying of the pail 52. While the skirt 70 has a maximum diameter of 12.750 inches and a width of 12.200 inches at the flattened areas 72, the sidewall 62 has an outer diameter of 5.608 inches at the base of the skirt and 5.639 inches at the top of the skirt. The hand-holds 78 are each 0.615 inch in depth with four provided spaced 5.872 inches circumferentially. Annular ribs 80, 82 around the sidewall 62 and above the skirt 70 keep the bead 66 round and ensure a good lid seal.

The floor 90 has a novel configuration and construction in order to reduce, if not eliminate, the doming problem experienced with the prior art pails. This is accomplished with two features which are preferably used together as in the preferred embodiments illustrated in the drawings. It is also, however, within the scope of the invention to use these two features separately to reduce the doming problem, as will be apparent to those skilled in the art. The first feature is the curving configuration of the floor as illustrated for example in FIGS. 6, 7 and 10 generally at 92. The second feature is the rib structure shown generally at 94 integrally molded on the top surface of the floor 90 and illustrated for example in FIGS. 2, 3 and 10. Due to the modulus of the geometry and for the amount of plastic used, more strength is added to the pail 52 by adding rib structure than by thickening the floor base, as a general rule.

The floor 90 has a thickness of between 0.110 and 0.115 inch in a preferred embodiment. It is configured (92) so that it bows in an exaggerated fashion upwardly in the central portion 96 thereof. Most prior art pails have a flat floor or an essentially flat floor having a curvature radius of typically one hundred, one hundred and fifty, or two hundred inches or more. In contrast, the curvature radius of the central section 96 is generally less than twenty-one inches and more preferably twenty inches, eighteen inches or even fifteen inches. For a six-gallon pail 52 the inside radius can be 20.000 and the outside radius 20.110 inch. This bowing of the present pail 52 helps reduce the doming problems by providing a resistance to the force, due to the internal pressure, in the vertical direction. Additionally, a flat geometry need only be deformed from flat to an outward dome to cause a potential problem in, for example, conveying operations. In contrast, the inwardly domed bottom must first be flattened and then domed outwardly to cause the same potential problems.

Figure 10:
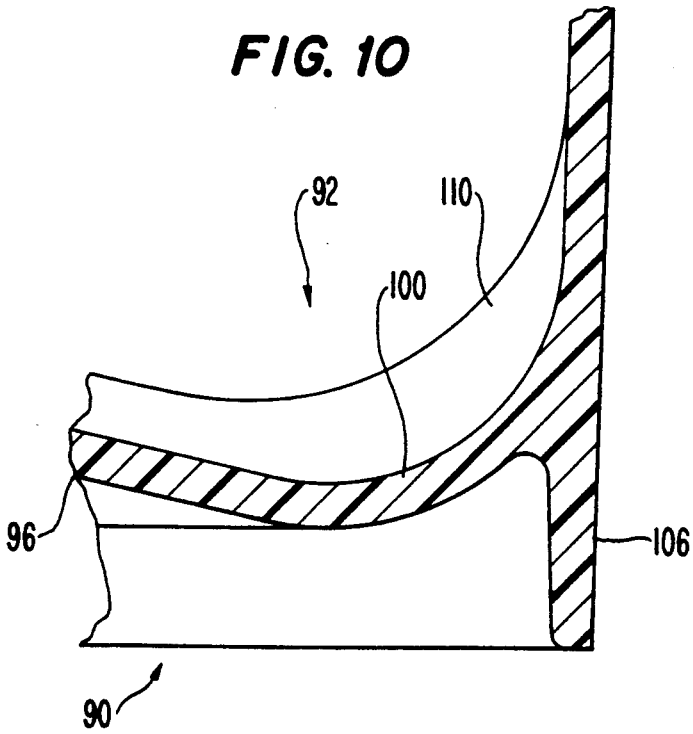
FIG. 10 is an enlarged view taken on circle 10 of FIG. 7.

At the perimeter of this central domed area 96 is an annular connecting area 100 for connecting the central section to the sidewall 62. As best illustrated in FIG. 10 it defines a very broad curve having a curvature radius of at least a half-an-inch and preferably 0.660 inch, or three-quarters of an inch. This large connecting curvature radius helps better transfer the stresses between the floor and the wall. Particularly, it distributes pail impact forces over a larger area and thereby makes the pail 52 more flexible. The prior art pails, in contrast, typically have a small curvature radius between their floors and sidewalls of only 0.05 inch. However, the larger the connecting radius, the higher the contact of the sidewall 62 with the floor 90, that is, the farther away from the bottom of the sidewall. This increases the height of the foot 106. If the foot 106 becomes too high it becomes a weak point of the pail 52, susceptible to caving in, thereby limiting the maximum curvature which can be used.

Figure 2:
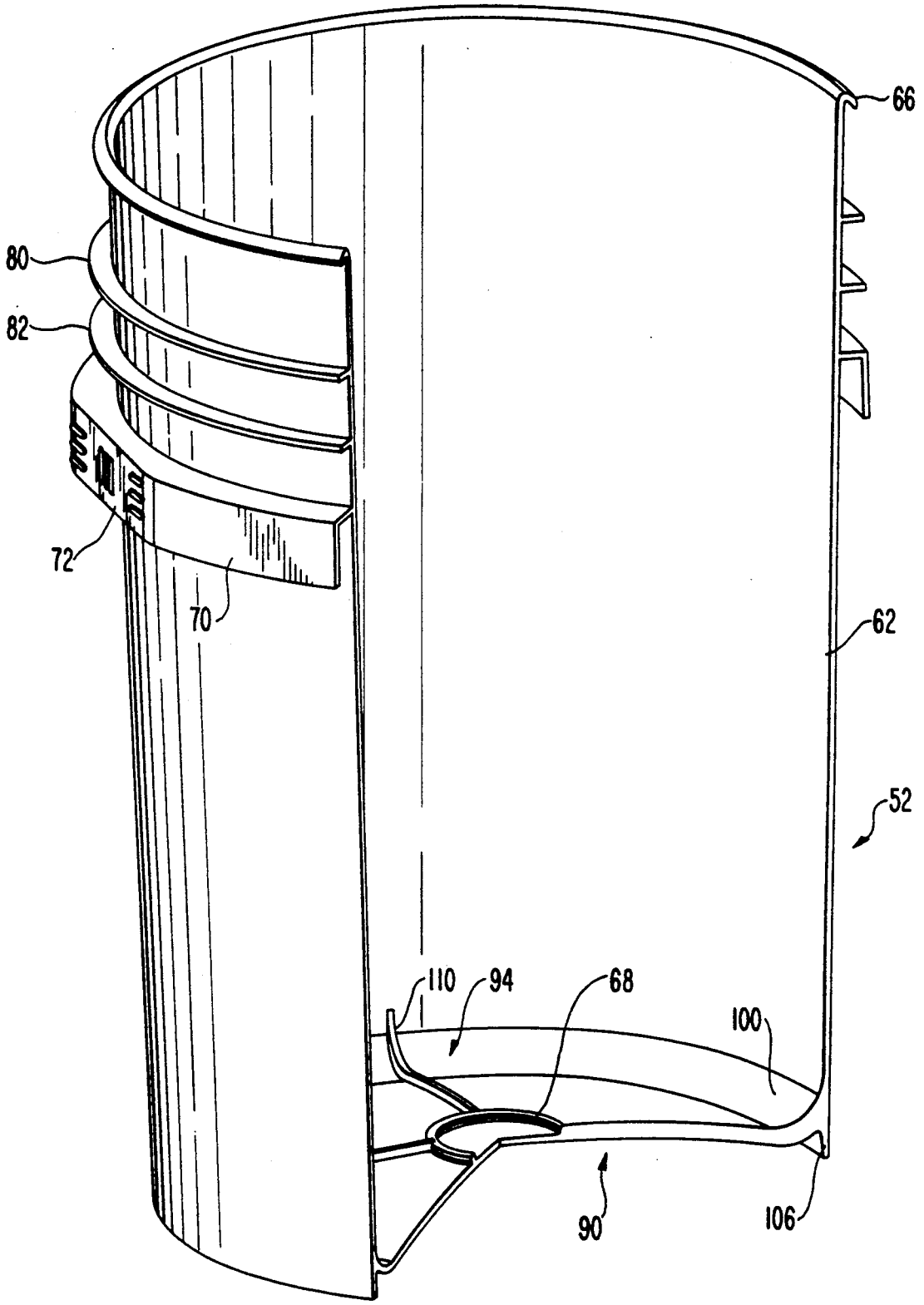
FIG. 2 is a top perspective view of the pail of FIG. 1 shown in isolation and with a portion thereof cut away for the sake of illustration.
Figure 3:
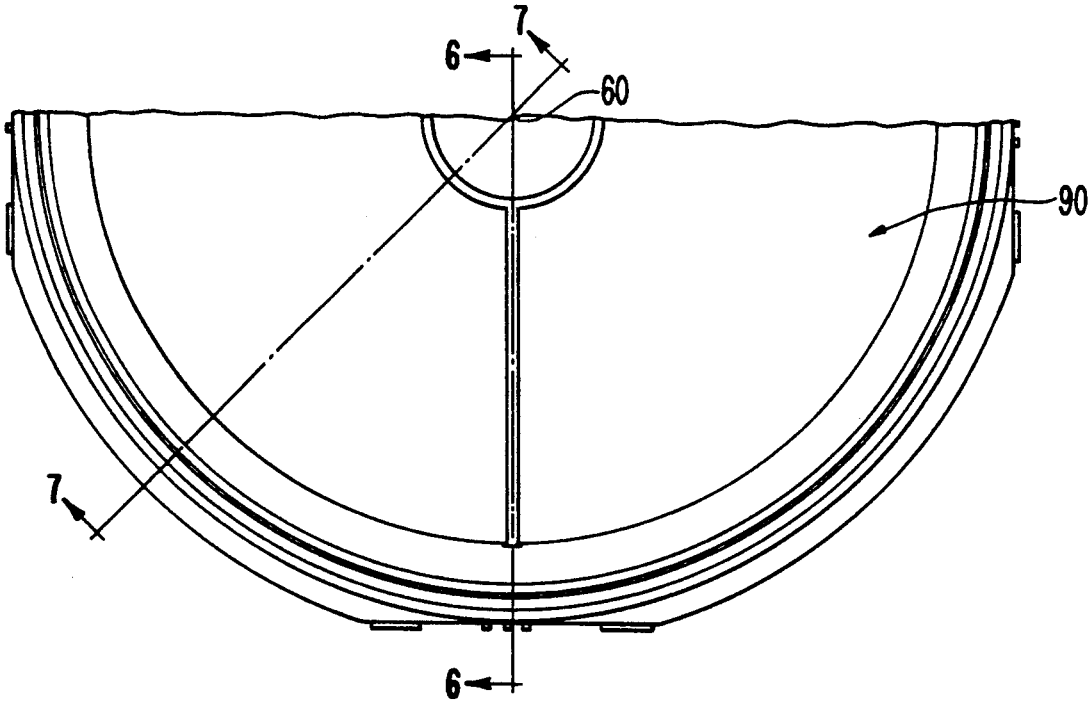
FIG. 3 is a top view of the pail of FIG. 2.
Figure 5:
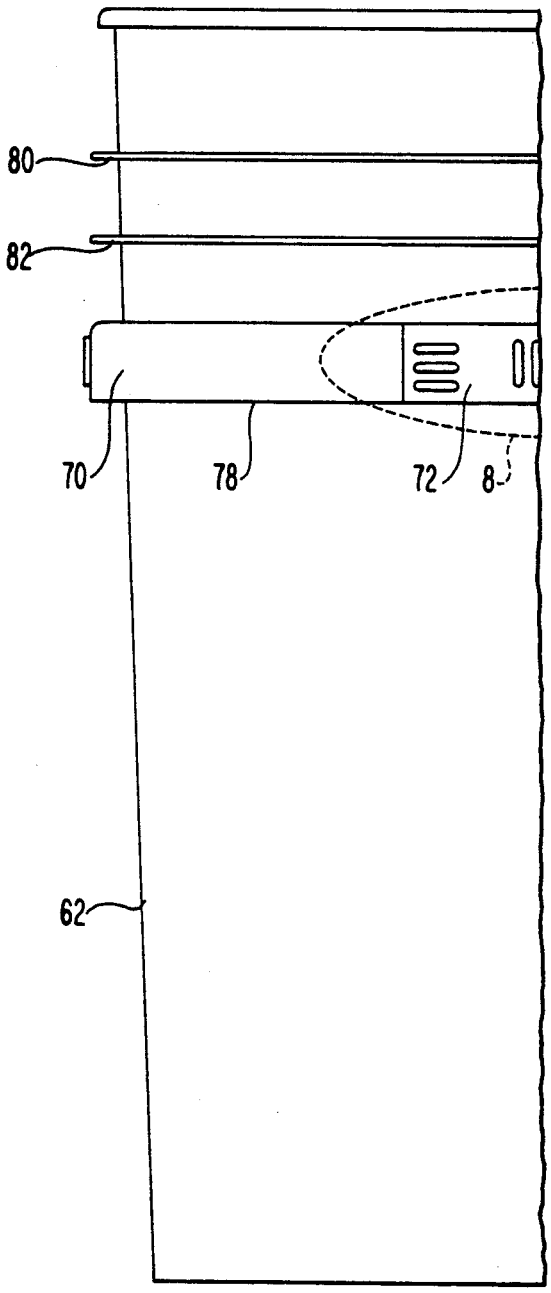
FIG. 5 is a side elevational view of the pail of FIG. 2.
Figure 6:
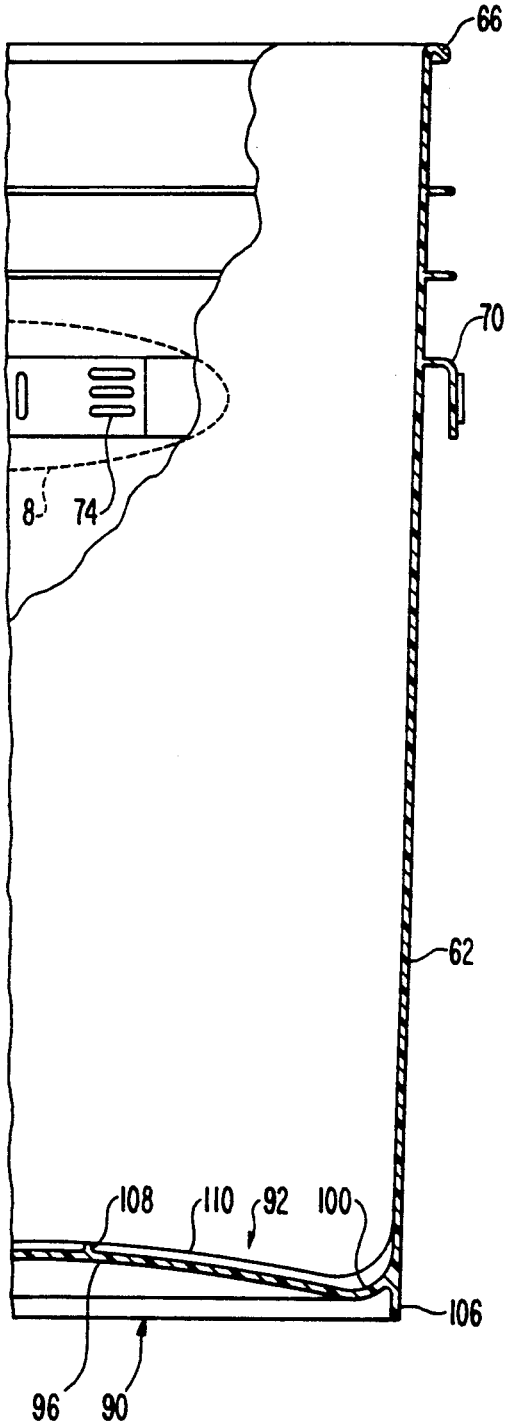
FIG. 6 is a cross-sectional view taken on line 6 of FIG. 3.
Figure 7:
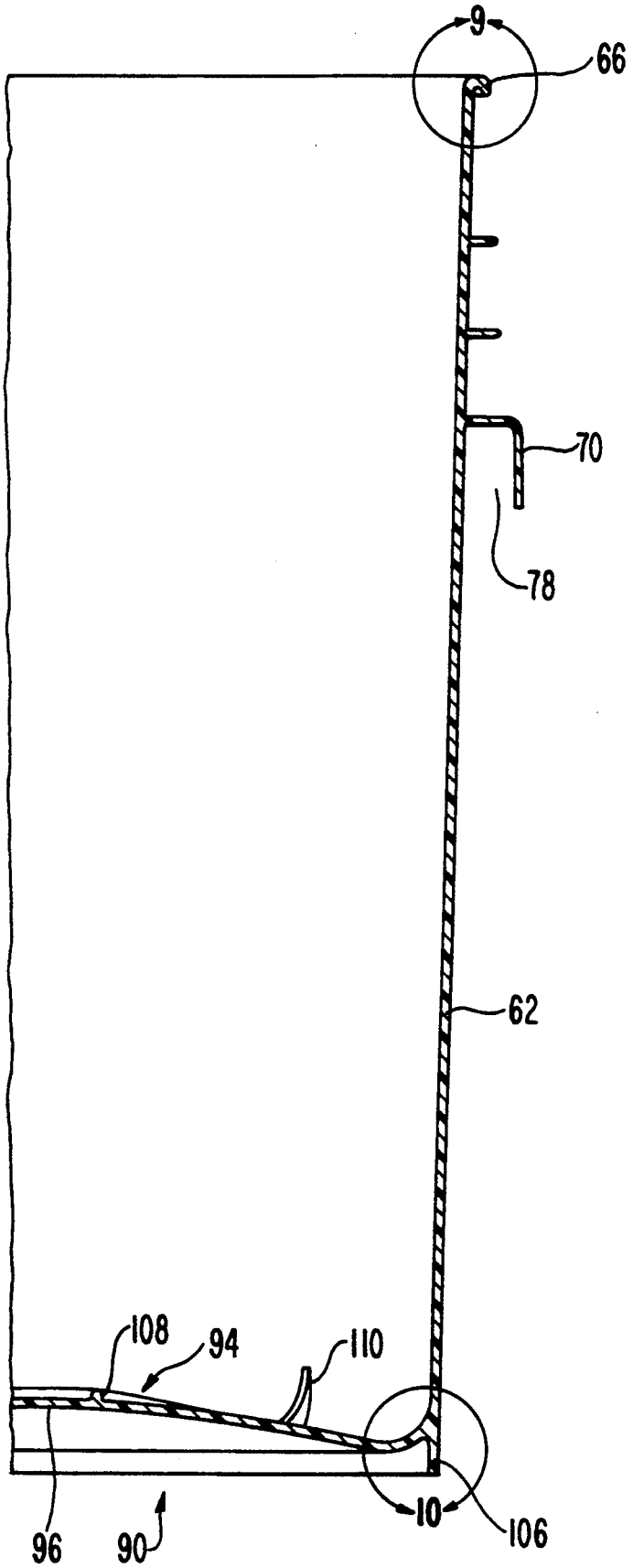
FIG. 7 is a cross-sectional view taken on line 7 of FIG. 3.

The rib structure 94, as can be understood from FIGS. 2 and 3 for example, is formed on the top surface of the floor 90. Since the rib structure 94 is on the top of the floor 90 as opposed to the bottom it does not interfere with pail stacking and frees up generally the entire bottom surface of the floor for graphics or decorations. Another difference between ribs on the outside versus ribs on the inside is that if any doming occurs, the ribs on the outside cause the same problems as the flat bottom design does. On the other hand, ribs on the inside cause no further problems than that of the inwardly domed base or floor. Rib structure 94 includes a central circular rib 108 and a plurality of radial ribs 110 extending radially out from the circular rib and engaging and even extending up the sidewall 62, as can be seen in FIGS. 2 and 10 for example. They extend up the sidewall 62 approximately 0.445 inch, which is advantageous because it allows a large radius at the intersection of the rib and sidewall, better distributing any stresses being transferred from one member to the other. The ribs 110 can have a height of between 0.140 and 0.20 inch and for example a height of 0.180 inch may be preferred. The width of each of the ribs 110 is between 0.08 and 0.120 inch, and preferably 0.110 inch at the top with side draft angles of 1.5 degrees. From a structural design standpoint the ribs 110 could extend all the way to the center of the floor 90 and directly engage each other, without a central circular rib (108), and still provide a good anti-doming result. However, from a molding standpoint this is difficult to produce. This circular rib 108 reduces the amount of plastic at the very center of the floor where it is difficult to cool the plastic, material shrinking can result and difficulty in filling the mold can be a problem.

Although four ribs 110 are shown, other numbers of equally spaced ribs can be provided. Two ribs alone might not provide enough support in the perpendicular direction, however. If an undesirable amount of doming is still experienced with the four rib (110) configuration then it can be altered, for example, by increasing the height of the ribs or increasing the numbers of the ribs. Six or eight ribs (110) thus would also be possible according to preferred designs. Care should be taken however that if the pail floor 90 (or the lid 54 as will be discussed later) is made too strong, as by adding too many ribs, that it may tend to break when dropped. The optimum number and sizing of the ribs 110 and the thickness and shape 92 of the floor 90 for specific uses will thus be a balancing of factors and can be determined by testing. For example, if the rib structure 94 is omitted and the floor curvature 92 itself is relied upon to address the doming problem, the floor 90 likely would have to be made thicker, from 0.110 to 0.115 inch for example. This, however, would increase the amount of plastic used and the likelihood of processing problems and breakage. Even if the central section 96 pail floor 90 of the present invention is pushed out a quarter of an inch by internal pail pressure, the present floor would still be inverted (domed inward) and would not bulge out. It would have to dome or bulge out about 0.8 inch (from flat) before it would cause a problem on a conveyor.

Figure 11:
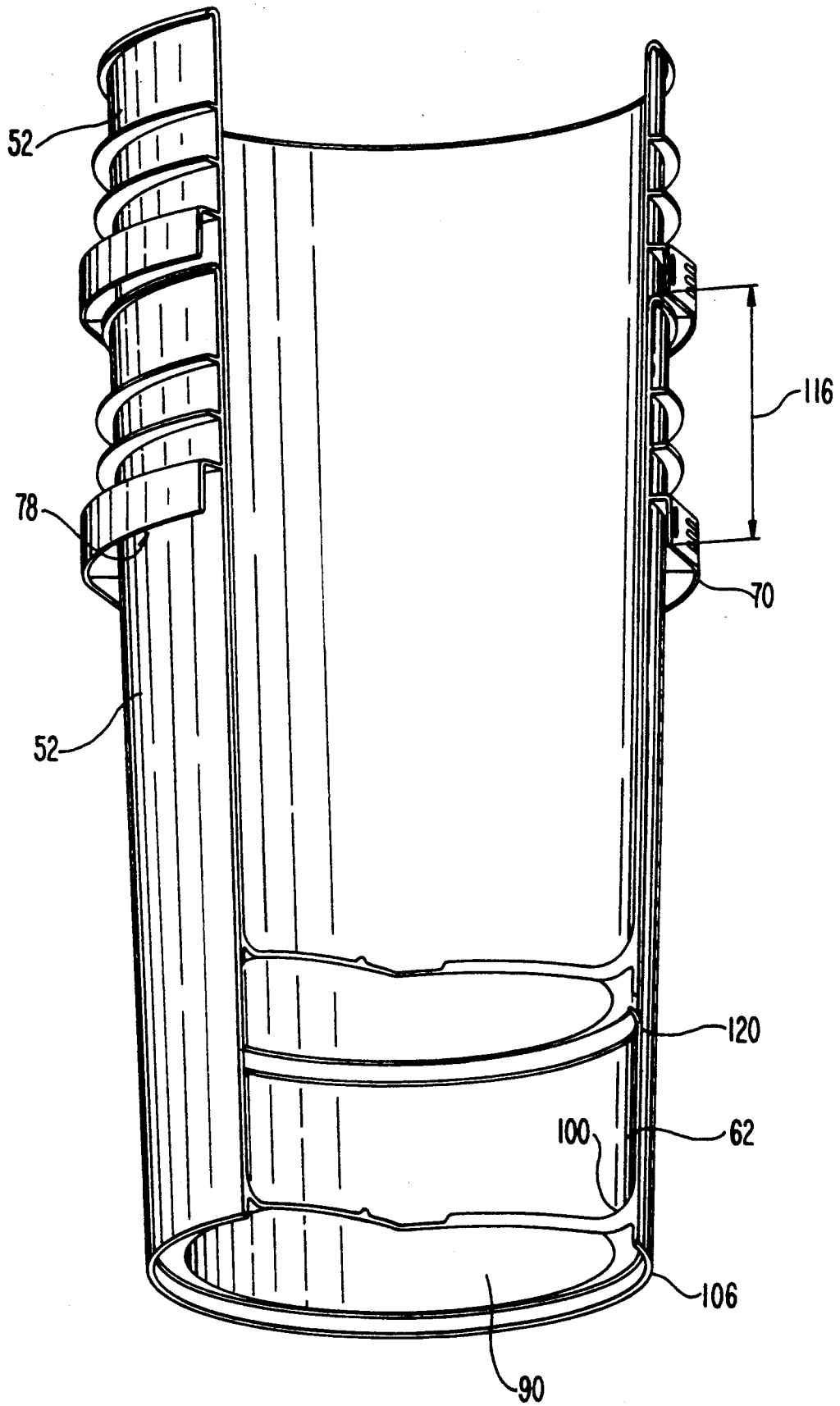
FIG. 11 is a bottom perspective view of the pail of FIG. 2 and a similar pail shown in an empty nested relation.

The draft angle of the pail sidewalls 62 allows the pails to be easily empty nested for more compact storage and transport. The stacking increment is shown in FIG. 11 at 116. The clearance 120 at the outside base of the top nested pail is 0.043 inch (for the six-gallon pail). If the nesting increment 116 were increased, this clearance 120 would also increase. The base diameter of the pail 52 being a large 10.408 inches for the seven gallon pail and 10.556 inches for the six gallon pail provides additional room between the inside of the sidewall 62 of the pail and the outside wall of the filling tube (not shown). This allows more air to escape during filling procedures, and thus pail filling to be quicker and more compact.

Figure 12:
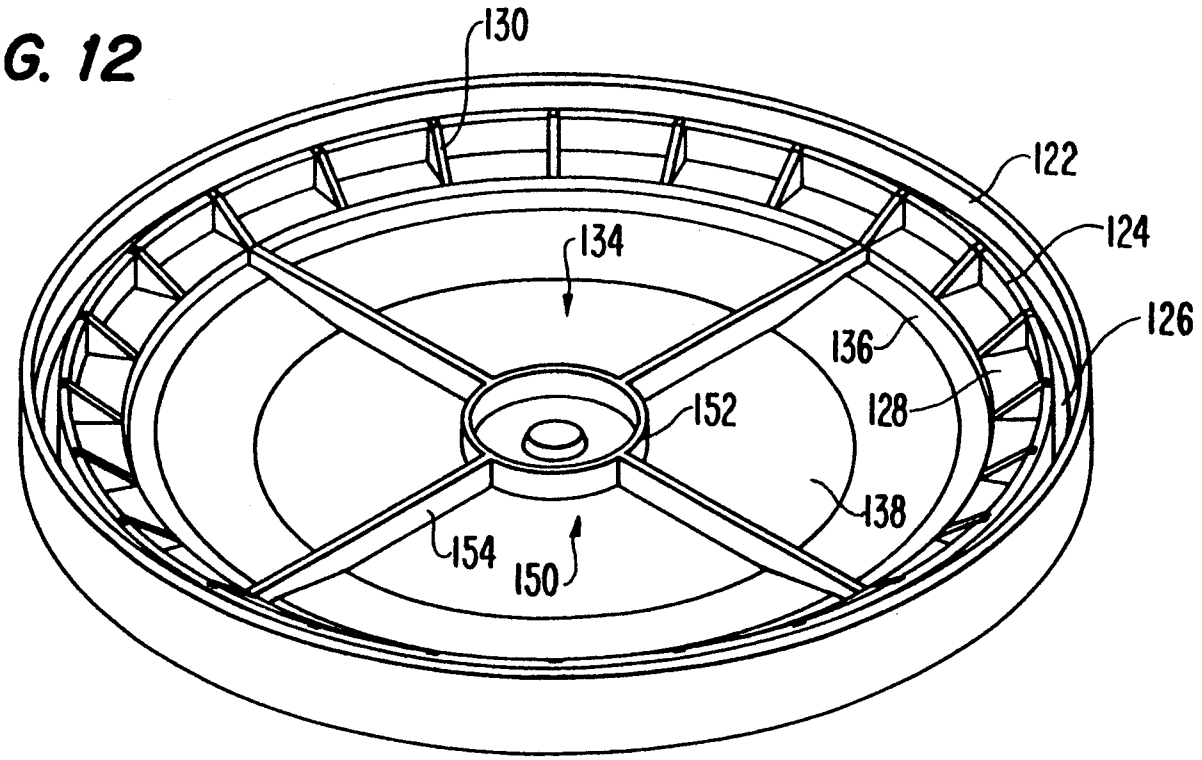
FIG. 12 is an enlarged bottom perspective view of the lid of the pail assembly of FIG. 1 and shown in isolation.

The lid 54 also has a unique construction to remedy the doming problems experienced with prior art lids. Referring, for example to FIG. 12 which shows the underneath of the lid 54, it is seen that the lid includes a circular edge outer flange 122 and a circular inner flange 124 defining therebetween an inverted U-shaped recess or channel 126 for snap-fit receiving the annular sealing bead 66 of the sidewall 62, as will be described in greater detail with respect to FIGS. 18 and 19. A raised annular band 128 extends about the inner periphery of the inner flange 124 and a plurality of spaced, triangular radially-disposed ribs 130 are mounted on this band. The inner center 134 of the lid has a multi-surfaced configuration approximating a dome of large curvature radius of approximately 19.75 inches. In particular, this multi-surface is defined by a narrow, generally flat perimeter ring 136 and adjacent thereto is a frusto-conical shaped ring 138 disposed at an angle of approximately ten degrees. The center 140 then is essentially flat, the very center 142 approximately one-inch in diameter dips in a slight distance, due to the injection molding process. It also provides some protection for the gate by locating it in a recess on the top of the lid 54. The recess then forms a nub on the bottom of the surface of the lid 54.

Provided on the bottom surface of the lid 54 and within the annular band 128 is a (lid) rib structure shown generally at 150 integrally formed thereon and configured similar to the rib structure 92 on the interior surface of the pail floor 90. In particular, it includes a circular rib member 152 and four ribs 154 extending radially out therefrom and to the perimeter of the annular band 128. The circular rib 152 and the portions of the radial ribs 154 adjacent the circular rib each have a height of approximately 0.4 inch. Due to the bowed configuration of the central lid portion 134, the outer ends of the radial ribs 154 adjacent the annular band 128 have a lesser height of approximately 0.2 inch. The lid 54 at its center has a thickness of approximately 0.100 inch (wall thickness and a 1.155 inch height), and the ribs 154 have widths of 0.110 inch or 0.080 inch at the top with a one degree draft angle at both sides thereof. Although four radial ribs 154 are illustrated, more can be used if desired.

The pails of the present invention for the six and seven gallon embodiments have identical open tops. Thus, the same lid 54 fits on both six and seven gallon embodiments. These two embodiments have the same draft angle for their sidewalls, but differ in their heights, the seven gallon pail being approximately 2¾ inches taller than the six gallon. This means that the "footprint" of the six gallon pail is larger than that of the seven gallon. This can be perhaps better understood by imagining a cone with its point at the bottom and slicing it at one location perpendicular to the axis and at a second one closer to the point. The closer one will have a smaller radius intersection.

Figure 13:
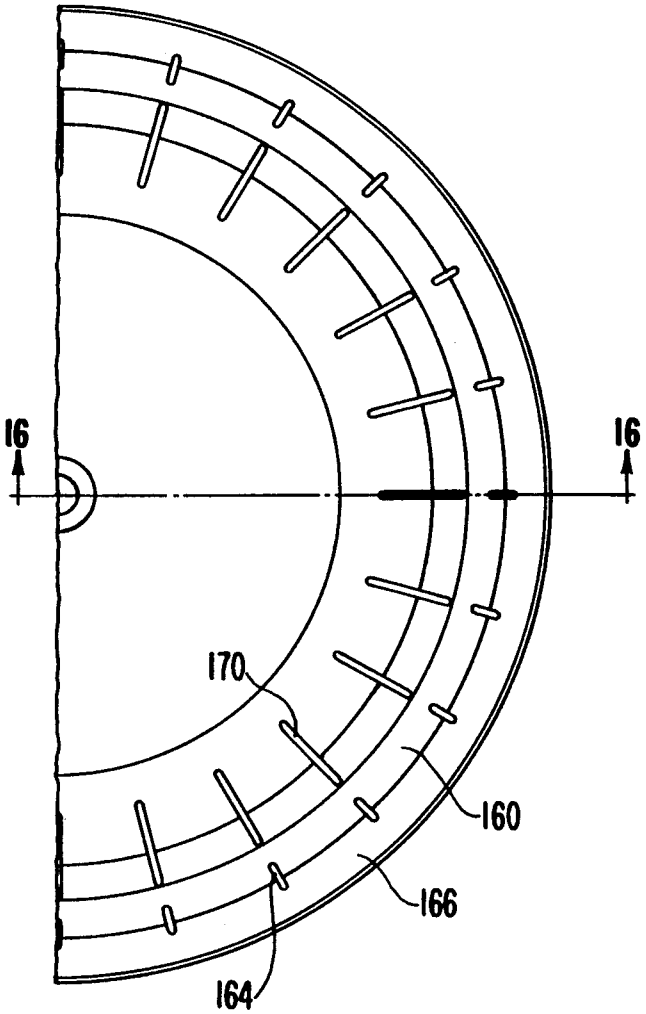
FIG. 13 is a top plan view of a lid similar to the lid of FIG. 12.
Figure 14:
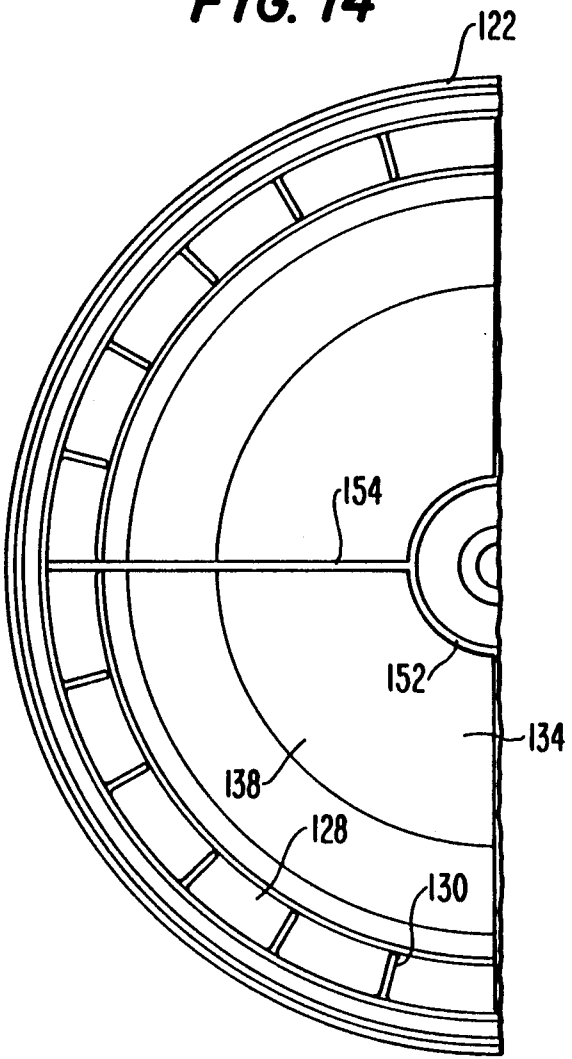
FIG. 14 is a bottom plan view of the lid of FIG. 13.
Figure 16:
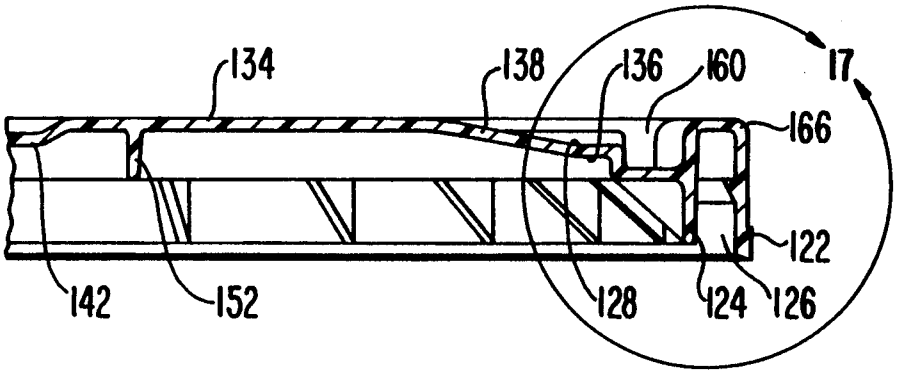
FIG. 16 is a cross-sectional view taken on line 16 of FIG. 13.
Figure 15:
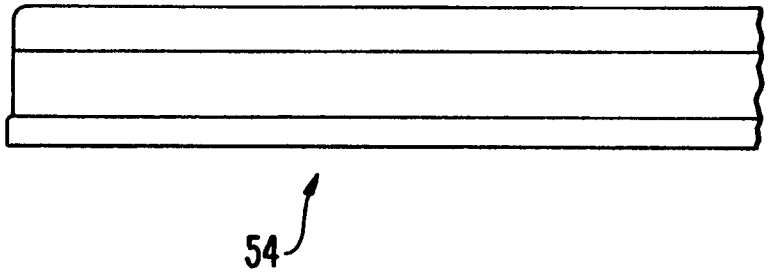
FIG. 15 is a side elevational view thereof.
Figure 17:
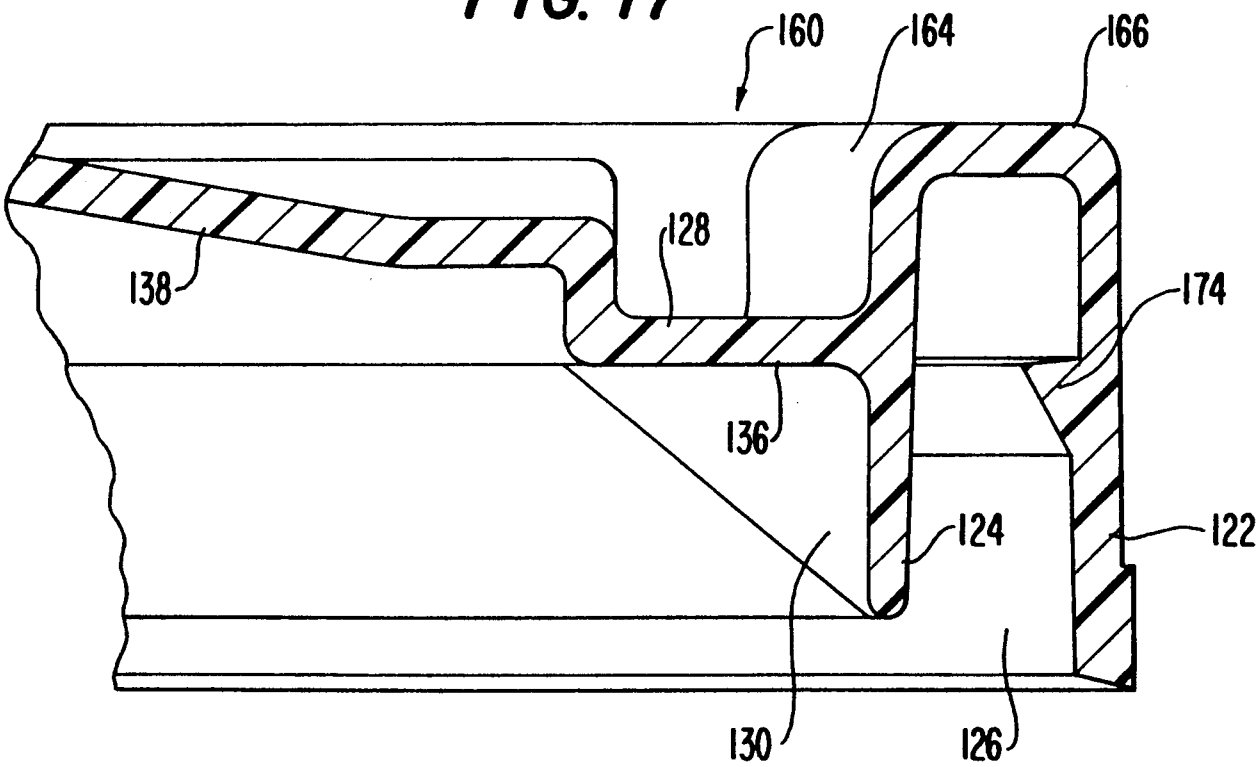
FIG. 17 is an enlarged view taken on circle 17 of FIG. 16.

When the pail assemblies (50) are loaded and stacked one on top of another, the bottom foot or rim 106, as shown in FIG. 10, fits into a receiving channel ring 160 on the top of the lid 54. This ring 160 is shown in FIGS. 13, 16 and 17 for example, and has a width of approximately 0.257 inch, or 0.491 inch beyond the outer rib. If this ring 160 has no sidewall structure or only very shallow angled sidewalls, then the pail (52) seated on top in the ring can tend to tip on the bottom lid (54) and possibly fall off. Accordingly, structures are provided, according to the present invention, to restrain this tipping action. These restraining structures and the channel 160 are uniquely configured to receive and also restrain tipping of both the narrow base of the seven gallon pail and the wider base of the six gallon pail.

On the outside of the channel 160 are a plurality of radial ribs 164 extending radially inward from the top rim 166 and spaced about the circumference thereof. These ribs are positioned to be approximately 0.040 inch away from the outer diameter circumferential surface of the six gallon base when aligned in the channel 160 and being close enough and extending high enough about the entire perimeter to restrain tipping of the six gallon pail. Inside rib structure is provided on the inside of the channel 160 to engage the inside perimeter surface of the narrower seven gallon pail base and spaced a very short 0.040 inch therefrom and extending up a distance from the base of the channel to thereby restrain tipping of the seven gallon pail when seated on the lid 54.

This inside rib construction can take either of two forms. It can be a radial rib structure 170 such as shown in FIG. 13 and extending radially inward on the opposite side of the channel 160 from the ribs 164 of the outside the channel. Alternatively it can take the form of a series of upstanding arcs 172, as shown in FIG. 18 for example, spaced one from another about the perimeter of the interior of the channel 160. Each arc 172 has its ends sloping down so as to form arc-free areas approximately an inch long between adjacent arcs. Functionally, these arcs 172 could be connected to form a circular rib extending the entire periphery instead of sloping down every couple of inches to define arcs. However, the arcuate configuration is preferred for processing reasons. If the rib (172) extended all the way around (that is, in a complete circle), air could get trapped during the injection molding process and the plastic rib might burn forming small holes in it. The geometry of the arcs 172 thus allows some of the air to escape as the plastic is injected, and thereby avoid burning.

Figure 19:
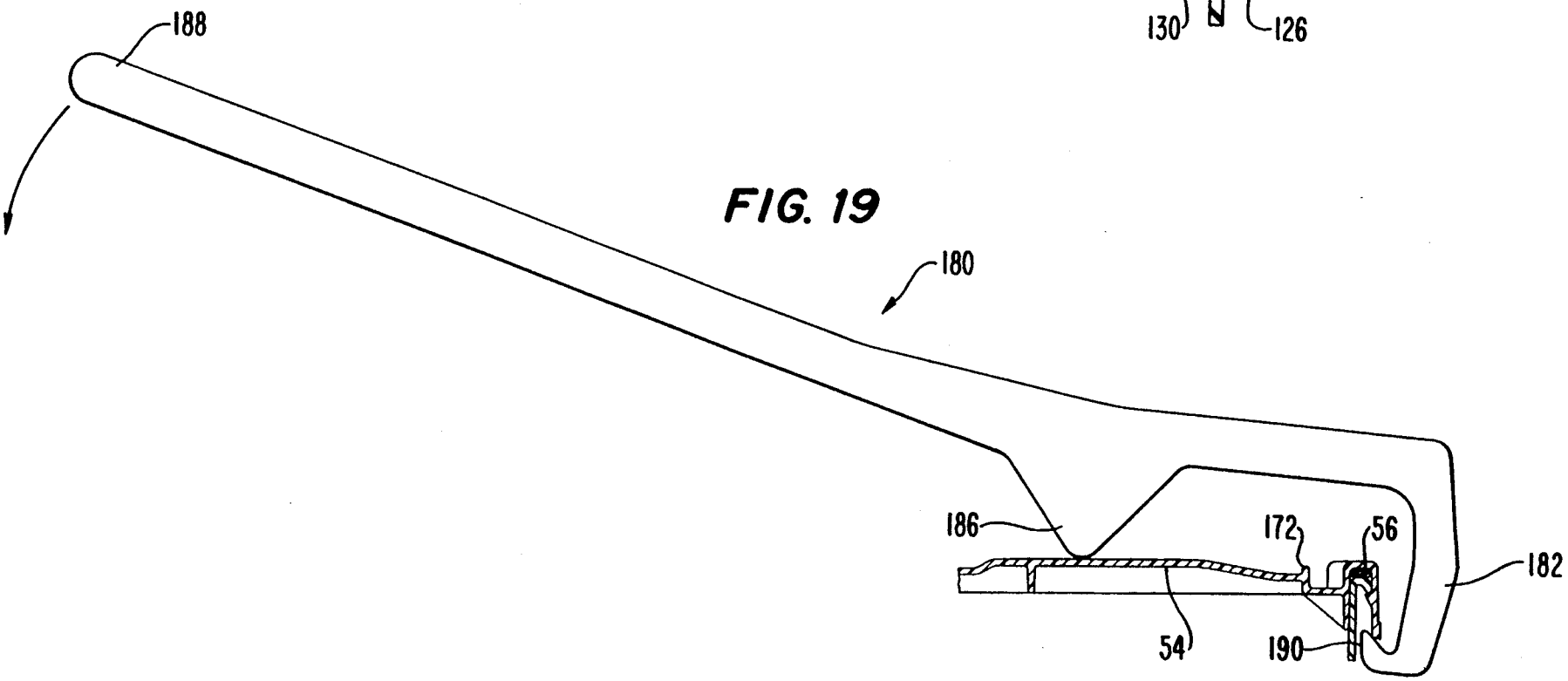
FIG. 19 is a view similar to the view of FIG. 18 showing a tool of the present invention for unsnapping the lid off of the pail.

Referring to FIGS. 17–19, the snap fit sealing of the lid 54 onto the pail 52 is best illustrated. It is seen therein that the O-ring 56 is positioned at the top of the U-shaped channel 126 and held therein by the nub or triangle 174 extending inwardly from the outer flange 122. When the lid 54 is then snap fit on the annular bead of the sidewall 62, the bead 66 pushes up against the O-ring 56 and snaps into the U-shaped channel 126 such that the bead 66 engages the top of the triangle 174, and thereby is held in the channel. To unsnap the lid 54 from the pail 52, a novel tool is herein provided as shown generally at 180 in FIG. 19.

Tool 180, made of steel for example, has an end hook portion 182 curving around to form a triangular fulcrum 186 extending down from the handle body and the handle end 188 then is distant from the fulcrum. The tool tip or point 190 is inserted in the U-shaped channel 126 generally against the outside of the sidewall and when the handle end 188 is pushed down, the tip is pulled up and out as the tool 180 pivots about the fulcrum 186 supported on the top of the lid 54. As it pulls the outer flange 122 away from the inner flange 124, the triangle 174 is pulled away from the tip of the annular bead 66 thereby releasing it.

In summary, the design of the present pail assembly 50 has a number of benefits and addresses some key issues of the prior art pails. For example, the integral octagonal skirt or handle with interlocking friction grips on four sides provides for added side-to-side layer stacking stability when stretch-wrapped. The tight positive base and lid locating ring channel area increase the vertical stacking stability.

Pail deformation is reduced since the internal arched ribbing on the internal surface of the lid retards the reverse doming caused by internal pail pressure and thereby increases palleting conveyor system stability. The thicker wall cross-sectional area retards bulging and collapsing under internal pressure. The increased internal bottom radius of the base and wall joint provide improved rupture and impact absorption strength in vertical and horizontal drops on both the sidewall and the floor. By increasing the wall thickness of the pail towards the base thereof the likelihood of bulging and collapse occurring near the base of the pail due to compressive loads is reduced. Also, by reducing reverse doming on the bottom of the pail a positive surface contact with automated belt and roller conveyor systems on packaging lines and automatic kiln elevating and staging areas is provided.

The integral wall handle eliminates the need for a bail handle which can cause pail hangups in kiln firing tubes when cocked during kiln rotation. The integral handle further encourages proper two-handed lifting techniques and thereby reduces back injuries caused when workers swing the prior art pails by their bail handles. The integral handle further eliminates potential punctures in sidewalls of the pails caused when the tag ends of the bail handles impact the sides of an adjacent pail. It is noted, however, that the present pail design can easily be adapted for bail handles in lieu of the integral wall handle design if the intended use requires it.

The internal ribbing on the lid also eliminates doming and holds a secure pressure seal, not merely to retain the seal once the lid has domed as some lids do. This ribbed lid retains the seal and absorbs impact stresses as during drop tests. It further is designed for easy removal and resealing of the lid to aid in random sampling of material. The external height with the lid fits all kiln firing window slots and allows for double stacking where applicable. The maximum outside dimensions of the pail assembly allow for a smooth sliding action inside the firing tubes during kiln rotation. The 1.60 degree draft angle allows for proper nesting and shipment of empty pails and allows for easy denesting at the processing facilities and the packaging lines.

The present pail assembly design and materials comply with current DOT-35 for plastic pail design requirements as well as the upcoming United Nations specifications. The virgin high density polyethylene with ultraviolet stabilizer used in injection molding the lid and the pail as well as the O-ring materials are compatible with the Chem-Fuel hazardous solids chart as provided by Cadence and also current DOT and UN specifications.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

What is claimed is:

1. A pail assembly comprising:

a pail including a plastic sidewall defining in part a pail interior, a sealing bead disposed around an open top of said pail, a plastic pail floor connected to said sidewall and having a floor top surface and a floor bottom surface, and a plastic floor rib structure integrally molded on and extending generally across said floor top surface, said sidewall defining a rim foot extending down below the lowermost surface of said floor, said floor rib structure extends upward from and generally across said floor top surface, said floor being bowed inwardly at a central location thereof to resist outward deformation of said floor, said floor rib structure comprising a circular floor rib member disposed in a central location of said floor top surface and a plurality of radial floor ribs extending radially out from said circular floor rib member, the perimeter of said bowed floor connected to said sidewall by an upwardly curved connecting area and said radial floor ribs extending up said curved connecting area and partially up said sidewalls, said floor rib structure configured to resist the outward doming of said floor lid outer surface when said pail interior is subjected to a positive pressure; and a plastic lid securable in a sealed tight relationship to said sidewall of said pail at said pail open top, said lid and said pail defining a pail interior, said lid including a circular edge outer flange and a circular edge inner flange defining a sealing bead receiving area therebetween for sealing engaging said sealing bead, a lid bottom surface generally within said edge inner flange, said lid bottom surface comprising a lid rib structure extending down from and generally across said lid bottom surface and integrally formed therewith, said lid rib structure comprising a circular lid rib member disposed in a central location of said lid bottom surface and a plurality of radial lid ribs extending radially out from said circular lid rib member, said lid rib structure being bowed outwardly and configured to resist the outward doming of said lid outer surface when said pail interior is subjected to a positive pressure, said lid also including an opposite lid outer surface having a receiving channel for stably receiving the rim foot of another pail assembly stacked thereon;

wherein said rim foot of said sidewall is adapted to engage the receiving channel on top of the lid of another pail assembly stacked therebeneath.

2. The pail assembly of claim 1 wherein said sealing bead is formed as an outward lip at the top of said sidewall, and said lid is snap fittable onto said lip, and said sidewall includes an integrally formed annular bead extending therearound for reinforcing said sidewall to ensure secure seal between said lid and said sealing bead.

3. The pail assembly of claim 1 further comprising plastic handles integrally formed on sides of said sidewall and disposed on an annular skirt extending around said sidewall.

4. The pail assembly of claim 1 wherein said lid includes a plurality of generally triangular bracing ribs secured to and bracing said inner flange and a raised annular band to which said bracing ribs are mounted, said annular band having an inner perimeter and said lid rib structure extending into said inner perimeter.

5. The pail assembly of claim 1 further comprising an O-ring seal fitted into said recess and against which said sealing bead abuts.

6. The pail assembly of claim 1 wherein said receiving channel having a channel outside and a channel inside, an outer blocking rib structure on said channel outside and an inner blocking rib structure on said channel inside.

7. The pail assembly of claim 6 wherein said inner blocking rib structure includes a plurality of upright, spaced arcuate ribs.

8. The pail assembly of claim 7 wherein said outer blocking rib structure includes a plurality of spaced inwardly directed radial ribs.

9. A plastic pail assembly including a plastic pail having a sidewall, a floor and an open-top, and a plastic lid securable to said open-top in a sealed relation, wherein said pail and said lid secured thereto define a pail interior, the improvement comprising:

said floor including a central floor portion and a perimeter floor portion about and adjacent said central floor portion and adjacent to said sidewall, said perimeter floor portion connected to said sidewall by an upwardly curved connecting area;

said floor having an interior surface thereof comprising a floor rib structure including a circular central floor rib and a plurality of radial floor ribs extending from said central floor rib, said radial floor ribs extending up said curved connecting area and partially extending up said sidewalls for resisting outward doming of said floor when said pail interior is subjected to an internal positive pressure;

said central floor portion bowing inwardly with a curvature radius of less than 25 inches; and said connecting area between perimeter floor portion and said sidewall bowing outwardly with a curvature radius greater than ½ inch;

wherein said central floor portion and said perimeter floor portion define a continuous curve, and wherein said sidewall defines a rim foot extending down below the lowermost surface of said floor, and said rim foot is adapted to engage the top of the lid of another pail assembly stacked therebeneath.

* * * * *